US009865373B2

(12) United States Patent
Schmidt et al.

(10) Patent No.: US 9,865,373 B2
(45) Date of Patent: Jan. 9, 2018

(54) ELECTRICAL WIRE WITH CONDUCTIVE PARTICLES

(71) Applicants: TYCO ELECTRONICS CORPORATION, Berwyn, PA (US); TE CONNECTIVITY GERMANY GmbH, Bensheim (DE)

(72) Inventors: Helge Schmidt, Speyer (DE); Majorie Kay Myers, Mount Wolf, PA (US); David Bruce Sarraf, Elizabethtown, PA (US); David Alan College, Annville, PA (US)

(73) Assignees: TE CONNECTIVITY CORPORATION, Berwyn, PA (US); TE CONNECTIVITY GERMANY GmbH, Bensheim (DE)

( * ) Notice: Subject to any disclaimer, the term of this patent is extended or adjusted under 35 U.S.C. 154(b) by 0 days.

(21) Appl. No.: 15/046,890

(22) Filed: Feb. 18, 2016

(65) Prior Publication Data

US 2016/0247599 A1 Aug. 25, 2016

Related U.S. Application Data

(60) Provisional application No. 62/120,706, filed on Feb. 25, 2015.

(51) Int. Cl.

| | |
|---|---|
| ***H01B 7/00*** | (2006.01) |
| ***H01B 1/02*** | (2006.01) |
| ***H01B 13/00*** | (2006.01) |

(52) U.S. Cl.

CPC ..... *H01B 7/0009* (2013.01); *H01B 1/023* (2013.01); *H01B 13/0036* (2013.01)

(58) Field of Classification Search

CPC ..... H01R 13/03; H01R 4/18; H01R 43/048
USPC ..... 439/877
See application file for complete search history.

(56) References Cited

U.S. PATENT DOCUMENTS

| | | | | |
|---|---|---|---|---|
| 2,869,103 | A * | 1/1959 | Wells | H01R 4/62 174/90 |
| 7,282,679 | B2 * | 10/2007 | Reichinger | H01R 4/62 174/84 C |
| 2004/0157504 | A1 * | 8/2004 | Fujimoto | H01R 13/03 439/877 |
| 2006/0201934 | A1 * | 9/2006 | Reichinger | H01R 4/62 219/553 |

(Continued)

FOREIGN PATENT DOCUMENTS

| | | | |
|---|---|---|---|
| JP | H08 321332 | A | 12/1996 |
| WO | 2013050328 | A2 | 4/2013 |
| WO | 2014122096 | A1 | 8/2014 |

OTHER PUBLICATIONS

International Search Report, Application No. PCT/US2016/019014, International Filing Date, Feb. 23, 2016.

*Primary Examiner* — Michael F McAllister

(57) ABSTRACT

An electrical wire includes a bundle of electrical conductors that has an end segment that extends to an end of the bundle. Each electrical conductor in the bundle engages at least one other electrical conductor. The electrical wire also includes conductive particles disposed between and engaging at least some of the electrical conductors in the bundle along the end segment. The conductive particles are configured to provide an electrical connection between the corresponding electrical conductors engaged by the conductive particles.

14 Claims, 6 Drawing Sheets

(56) References Cited

U.S. PATENT DOCUMENTS

2014/0194015 A1* 7/2014 Schmidt ..... H01H 1/5866
439/877
2014/0220836 A1* 8/2014 Schmidt ..... C22C 9/00
439/877

* cited by examiner

ELECTRICAL WIRE WITH CONDUCTIVE PARTICLES

CROSS-REFERENCE TO RELATED APPLICATIONS

This application claims priority to U.S. Provisional Application No. 62/120,706, filed 25 Feb. 2015, which is incorporated by reference in its entirety.

BACKGROUND OF THE INVENTION

The subject matter described and/or illustrated herein relates generally to electrical wires that have a bundle of plural electrical conductors therein.

Electrical terminals are often used to terminate the ends of wires. Such electrical terminals typically include an electrical contact and a crimp barrel. The crimp barrel includes an opening that receives an end of the wire therein. The crimp barrel is crimped around the end of the wire to establish an electrical connection between electrical conductors in the wire and the terminal as well as to mechanically hold the electrical terminal on the wire end. When crimped over the wire end, the crimp barrel establishes an electrical and mechanical connection between the conductors of the wire and the electrical contact.

Conductors of wires are often fabricated from copper, copper alloys, copper clad steel, etc. However, as the cost of copper has risen, aluminum represents a lower cost alternative conductor material. Aluminum also has a lighter weight than copper, so aluminum represents a lower weight alternative conductor material as well. But, using aluminum as a conductor material is not without disadvantages. For example, one disadvantage of using aluminum as a conductor material is the formation of a tightly adherent, poorly conductive oxide layer on the exterior surface of the conductor when the conductor is exposed to atmosphere. In addition, build-up of surface contaminants from processing steps may further inhibit surface conductivity. Such oxide and/or other surface contaminant layers may be formed on other conductor materials, but can be especially difficult to deal with for aluminum.

Accordingly, such exterior conductor surface oxide layers must be penetrated to contact the aluminum material to establish a reliable electrical connection between a wire and an electrical terminal and/or to establish a reliable electrical connection between different conductors of the wire. For example, as a conductor wipes against another conductor and/or the electrical terminal during crimping, at least a portion of the oxide layer of the conductor(s) may be displaced to expose the aluminum material of the conductor (s). But, it may be difficult to displace enough of the oxide layer during the crimping operation to achieve a sufficient electrical and mechanical bond, and thereby establish a reliable electrical connection, especially for larger diameter wires that include a greater amount of electrical conductors. A need remains for enhancing the electrical connections between multiple electrical conductors and/or between electrical conductors and the terminal to improve the conductive properties of the wire and any terminal assembly including the wire.

BRIEF DESCRIPTION OF THE INVENTION

In one embodiment, an electrical wire is disclosed that includes a bundle of plural electrical conductors that has an end segment that extends to an end of the bundle. Each electrical conductor in the bundle engages at least one other electrical conductor. The electrical wire also includes conductive particles disposed between and engaging at least some of the electrical conductors in the bundle along the end segment. The conductive particles are configured to provide an electrical connection between the corresponding electrical conductors engaged by the conductive particles.

In another embodiment, a method for producing an electrical wire is disclosed. The method includes applying an electrically insulating sheath around a bundle of electrical conductors. The electrical conductors in the bundle engage adjacent electrical conductors and extend to an end. The method also includes introducing conductive particles into an end segment of the bundle of electrical conductors that extends to the end. The conductive particles are introduced such that at least some of the conductive particles are disposed between adjacent electrical conductors along the end segment. The conductive particles are configured to provide an electrical connection between the corresponding adjacent electrical conductors engaged by the conductive particles.

In another embodiment, a particle applicator device for supplying conductive particles to an electrical wire is disclosed. The particle applicator device includes a guide block and a pressurized air feeder. The guide block extends between a front and a rear. The guide block has a channel extending through the guide block to a front opening at the front. The front opening of the guide block is configured to be fluidly connected to an end segment of an electrical wire. The channel of the guide block is configured to receive a supply of conductive particles therein. The pressurized air feeder is configured to supply an air stream through the channel from an air inlet of the channel that is spaced apart from the front opening. The air stream is supplied towards the front opening to spray the conductive particles in the channel axially into the end segment of the electrical wire.

DETAILED DESCRIPTION OF THE INVENTION

One or more of the embodiments disclosed herein provide an electrical wire that has conductive particles disposed between electrical conductors of the wire interior of an insulating sheath of the wire. The conductive particles are configured to enhance the inter-wire bonds and electrical connections between the conductors, such as during a crimping operation in which the wire is terminated to an electrical terminal to form a terminal assembly. Furthermore, the conductive particles may be applied to the end of the wire after the wire is constructed, shortly before the wire is crimped to a terminal. In addition, the conductors need not be twisted or helically wound around one another in order to secure the conductive particles to the conductors. Thus, the wire in the embodiments described herein may be simpler to construct (including the application of the conductive particles) than if the conductive particles were applied to the conductors, for example, prior to applying the sheath of the wire and/or as the conductors are being wound around one another. By applying the conductive particles in an axial direction into the end of the wire, as disclosed herein, at least some of the conductive particles are received between interior conductors that do not engage the sheath and some of the conductive particles are received on and between exterior conductors that do engage the sheath. The embodiments described herein may improve bonding and electrical conductivity both between interior conductors and between exterior conductors and the crimp barrel of the terminal, whereas, for example, applying the conductive particles directly to the crimp barrel of the terminal prior to the crimping operation only supports the bonding and conductivity between the exterior conductors and the terminal.

Figure 1:
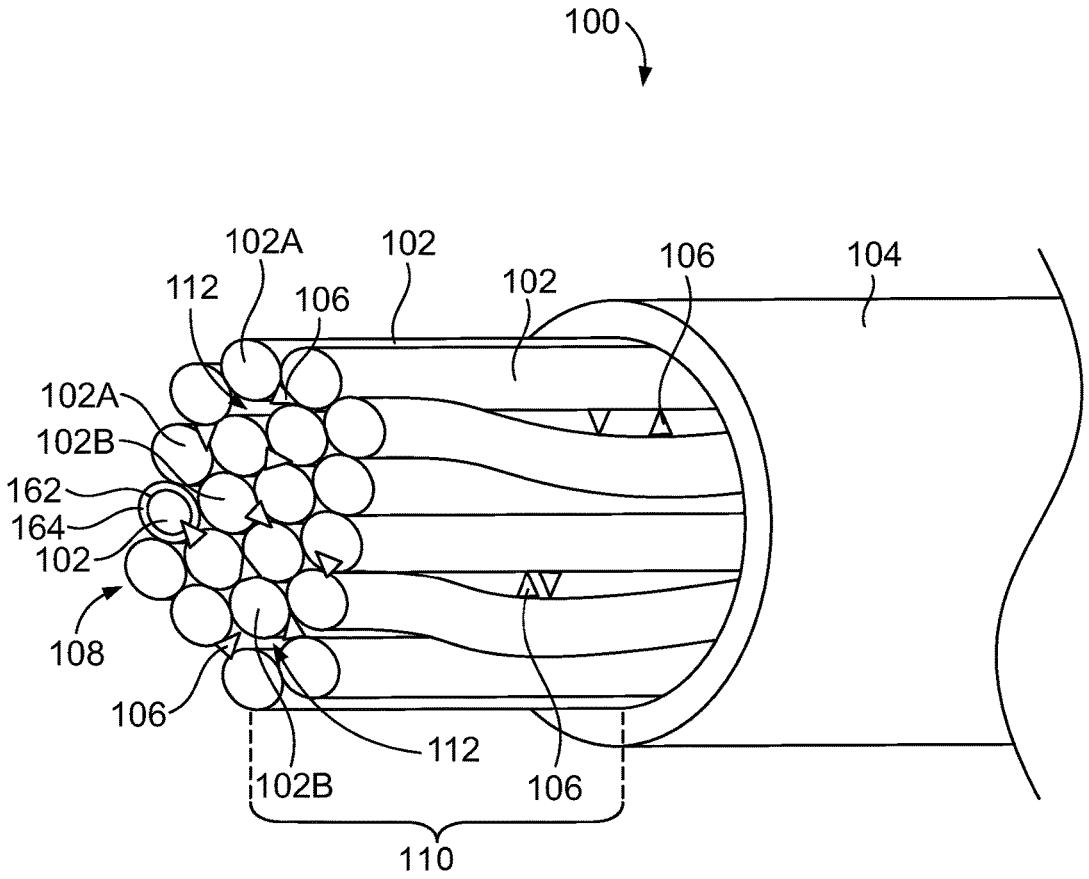
FIG. 1 is a perspective view of a portion of an electrical wire according to an embodiment.

FIG. 1 is a perspective view of a portion of an electrical wire 100 according to an embodiment. The electrical wire 100 includes a bundle of plural electrical conductors 102 grouped together within an electrically insulating sheath 104. As used herein, the "bundle" of electrical conductors 102 means that the electrical conductors 102 are commonly held within the insulating sheath 104 along at least a portion of the lengths of the conductors 102. The electrically insulating sheath or insulation layer 104, referred to herein as sheath 104, surrounds the bundle of electrical conductors 102. The electrical conductors 102 are configured to convey electrical current for power and/or signal transfer. The sheath 104 electrically insulates the bundle of electrical conductors 102 from the exterior environment, and may also provide mechanical protection for the electrical conductors 102. The electrical wire 100 also includes conductive particles 106 disposed between at least some of the electrical conductors 102. The conductive particles 106 engage the surfaces of the conductors 102 and provide an electrical connection between the conductors 102 engaged by the conductive particles 106.

The portion of the electrical wire 100 shown in FIG. 1 includes an end 108 of the wire 100. The end 108 of the wire 100 is defined partially or entirely by the electrical conductors 102. In the illustrated embodiment, an exposed portion of the bundle of electrical conductors 102 protrudes axially beyond the sheath 104 to the end 108 and is not surrounded by the sheath 104. Thus, the conductors 102 are exposed to the environment along the exposed portion of the bundle. The conductive particles 106 may be located at various distances along the wire 100 from the end 108. At least some of the conductive particles 106 may be disposed along a non-exposed portion of the bundle that is surrounded by the sheath 104.

In an embodiment, as described in more detail herein, the conductive particles 106 in an embodiment are applied to an end segment 110 of the wire 100 that extends to the end 108. The conductive particles 106 may be applied to the end segment 110 after the electrical conductors 102 and the sheath 104 of the wire 100 are constructed. The end segment 110 optionally may be a portion of the wire 100 in which the electrical conductors 102 are not surrounded by the sheath 104. For example, the end segment 100 may be created by removing a section of the sheath 104 from a length of wire 100 (formerly) covered in its entirety with the sheath 104. In another embodiment, the end segment 110 may include at least a portion of the sheath 104 surrounding the electrical conductors 102. The conductive particles 106 may be introduced to the wire 100 in an axial direction through the end 108 of the wire 100. The conductive particles 106 may be introduced to the wire 100 before or after removal of a portion of sheath 104 to expose the electrical conductors 102 for termination of the wire 100. The conductive particles 106 may penetrate and be received through the end 108 through interstices 112 between adjacent conductors 102. For example, the conductive particles 106 may be sprayed axially into the end 108 of the wire 100. Alternatively, the conductive particles 106 may be introduced by dipping the end segment 110 into a composition that includes the conductive particles 106 and a carrier agent. In another alternative embodiment, the conductive particles 106 may be applied by brushing the particles 106, with or without a carrier agent, onto the end segment 110. In yet another embodiment, the particles 106 can be sprayed in a radial direction into the end segment 110.

Unlike some known wires, the conductors 102 in an embodiment are not twisted or helically wound around one another within the sheath 104. Since the conductors 102 are not twisted, some of the interstices 112 between the conductors 102 may extend uninterrupted for a length at least equal to the length of the end segment 110. As a result, the conductive particles 106 applied to the end 108 of the wire 100 engage the conductors 102 at various distances along the end segment 110 from the end 108 (or even beyond the end segment 110).

Figure 2:
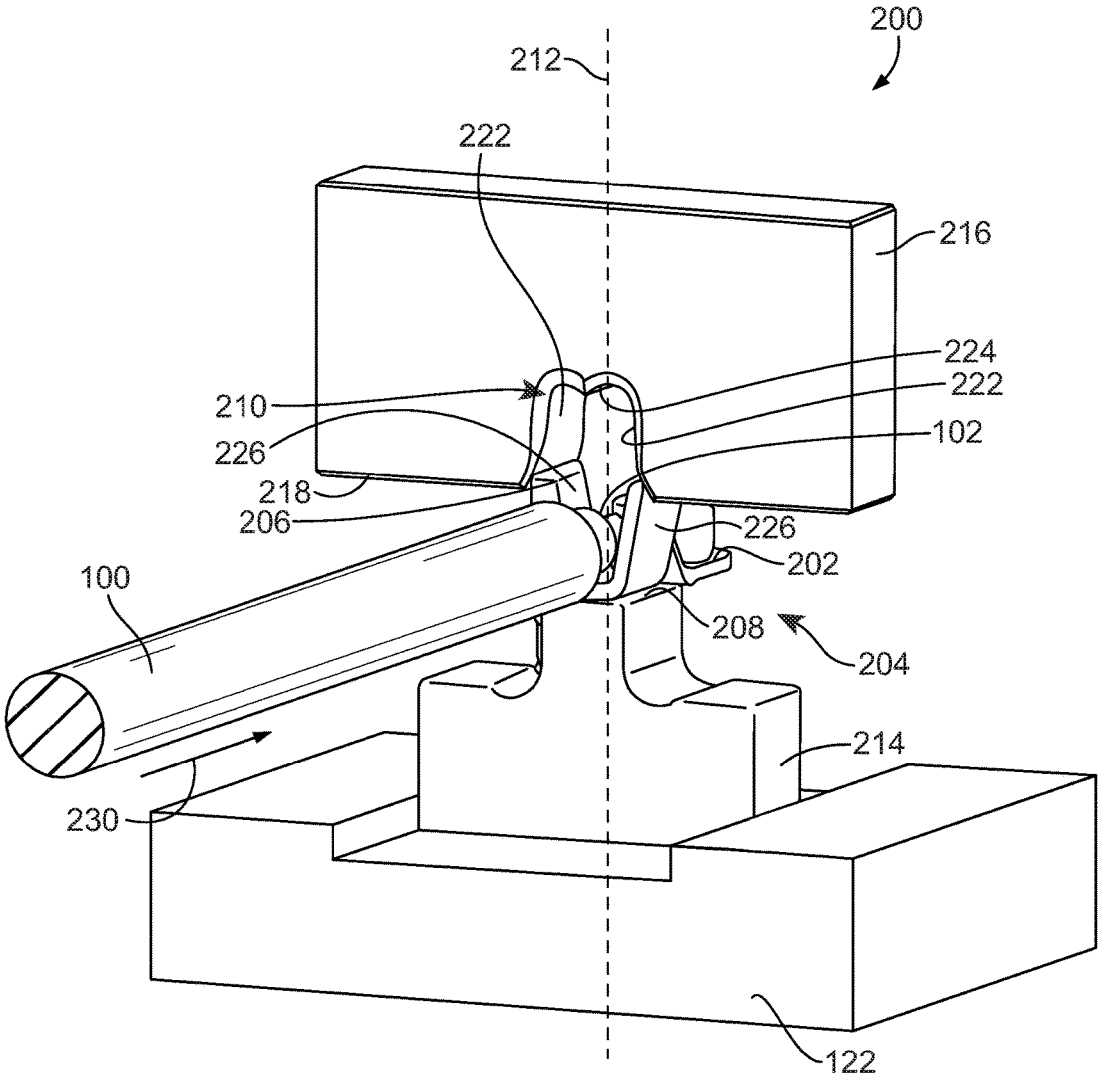
FIG. 2 is a perspective view of an embodiment of a crimping device.

The electrical wire 100 may be configured to be crimped to an electrical terminal 202 (shown in FIG. 2) to form a terminal assembly 204 (FIG. 2). For example, once the conductive particles 106 are applied to the conductors 102 of the wire 100, the end segment 110 of the wire 100 may be presented to a crimping device 200 (shown in FIG. 2) and loaded into a crimp barrel 206 (FIG. 2) of an electrical terminal 202, as described in further detail with reference to FIG. 2.

FIG. 2 is a perspective view of an embodiment of a crimping device 200. The crimping device 200 crimps an electrical terminal 202 to the electrical wire 100. The electrical terminal 202 and the electrical wire 100 form a terminal assembly 204. The terminal 202 includes a crimp barrel 206 that receives the end segment 110 (shown in FIG. 1) of the wire 100. During a crimping operation, the crimp barrel 206 is crimped around the conductors 102, forming a mechanical and electrical connection between the terminal 202 and the electrical wire 100. The electrical terminal 202 may be fabricated from any materials, such as, but not limited to, copper, a copper alloy, copper clad steel, aluminum, nickel, gold, silver, a metal alloy, and/or the like. For example, the electrical terminal 202 may be fabricated from a copper base that is plated with nickel.

The crimping device 200 includes an anvil 214 and a crimp tooling member 216. The anvil 214 has a top surface 208 that receives the terminal 202 thereon. The electrical conductors 102 along the end segment 110 (shown in FIG. 1) of the wire 100 are received in the crimp barrel 206 of the terminal 202 on the anvil 214. The crimp tooling member 216 includes a forming profile 210 that is selectively shaped to form or crimp the barrel 206 around the conductors 102 when the forming profile 210 engages the terminal 202. The terminal 202 is crimped to the wire 100 between the crimp tooling member 216 and the anvil 214. The crimp tooling member 216 is movable towards and away from the anvil 214 along a crimp stroke. The crimp stroke has an upward component away from the anvil 214 and a downward component towards the anvil 214. The crimp tooling member 216 moves bi-directionally, towards and away from the anvil 214, along a crimp axis 212. The crimp tooling member 216 forms the crimp barrel 206 of the terminal 202 around the electrical conductors 102 during the downward component of the crimp stroke as the crimp tooling member 216 moves towards the anvil 214. Although not shown in FIG. 2, the crimp tooling member 216 may be coupled to a mechanical actuator that propels the movement of the crimp tooling member 216 along the crimp stroke. For example, the crimp tooling member 216 may be coupled to a movable ram of an applicator or lead-maker machine. In addition, the applicator or the lead-maker machine may also include or be coupled to the anvil 214.

The forming profile 210 may include two side walls 222 that each extend from a bottom side 218 of the crimp tooling member 216 and a top-forming surface 224 that extends between the two side walls 222. The top-forming surface 224 in FIG. 2 may have a double-arch or "m" shape. In an embodiment, the crimp barrel 206 is at least partially defined by two tabs 226 of the terminal 202. During a crimping operation, as the crimp tooling member 216 moves toward the anvil 214, the forming profile 210 descends over the crimp barrel 206 and engages the tabs 226 to bend or form the tabs 226 around the electrical conductors 102. More specifically, the side walls 222 and the top-forming surface 224 of the forming profile 210 gradually bend the tabs 226 over a top of the electrical conductors 102 as the crimp tooling member 216 moves downward. At a bottom dead position of the crimp tooling member 216, which is the lowest position of the crimp tooling member 216 during the crimp stroke, part of the forming profile 210 may extend beyond the top surface 208 of the anvil 214. The terminal 202 is compressed between the forming profile 210 and the anvil 214, and the high compressive forces cause the tabs 226 of the terminal 202 to mechanically engage and electrically connect to the electrical conductors 102 of the wire 100, forming the terminal assembly 204. The high compressive forces produce metal-to-metal bonds between the crimp barrel 206 and the conductors 102, and between two or more adjacent conductors 102.

During the crimping operation, the forces applied to the conductors 102 from the crimping device 200 via the crimp barrel 206 may cause the conductive particles 106 (shown in FIG. 1) between the conductors 102 to embed into the conductors 102. For example, the conductive particles 106 may extend through oxidation layers that form on the outer perimeter of the conductors 102, as described in more detail herein. The conductive particles 106 may penetrate or break apart the oxidation layers, enhancing the conductivity of transverse electrical connections between the conductors 102 (for example, relative to the conductivity of transverse electrical connection between conductors 102 after a crimping operation without the presence of the conductive particles 106). For example, the conductive particles 106 may effectively form conductive bridges that provide a transverse current path between adjacent conductors 102. Furthermore, the conductive particles 106 may improve the strength of bonds that form between conductors 102 during the crimping operation due to penetrating the oxidation layers and/or due to intermolecular forces between the conductors 102 and the conductive particles 106.

Referring now back to FIG. 1, the electrical wire 100 may include any number of the electrical conductors 102. In an embodiment, the cross-sectional area of the conductors 102 is at least 10 $mm^2$. For example, the cross-sectional area of the conductors 102 may be up to or over 60 $mm^2$. The electrical conductors 102 may be fabricated from any materials, such as, but not limited to, aluminum, an aluminum alloy, copper, a copper alloy, copper clad steel, nickel, gold, silver, a metal alloy, and/or the like. In the illustrated embodiment, the electrical conductors 102 are fabricated from aluminum. Aluminum provides a low weight and low cost alternative to copper, for example. Optionally, some of the electrical conductors 102 may be formed of other metals other than aluminum.

One disadvantage, however, of using aluminum as an electrical conductor material is an oxide layer and/or other surface contamination layer (such as, but not limited to, residual wire extrusion enhancement materials, and/or the like) that may build on the metallic (i.e., aluminum) surface of the electrical conductors 102. The oxide and/or other surface material layers may form, for example, when the conductors 102 are exposed to atmosphere and/or during processing (e.g., an extrusion process and/or the like) of the electrical conductors 102. Such oxide and/or other surface material layers may be formed on other conductor materials besides aluminum, but can be particularly difficult to deal with for aluminum. It should be understood that the embodiments described and/or illustrated herein are applicable and may be used with embodiments wherein one or more of the electrical conductors 102 are fabricated from a material other than aluminum. Moreover, the embodiments described and/or illustrated herein will be described below with respect to oxide layers, but it should be understood that the methods and crimp tools described and/or illustrated herein may be used with respect to other surface material layers in addition or alternative to the oxide layers.

The electrical conductors 102 of the electrical wire 100 include a group of exterior electrical conductors 102A that form a perimeter of the group of electrical conductors 102. The electrical conductors 102 include a group of interior electrical conductor 102B that are surrounded by the exterior electrical conductors 102A. In an embodiment, the conductive particles 106 are secured to surfaces of the exterior electrical conductors 102A and the interior electrical conductors 102B. For example, some particles 106 may engage an interior surface portion of one exterior conductor 102A in an interstice 112 between the exterior conductor 102A and an interior conductor 102B. Other particles 106 may engage an exterior surface portion of the same exterior conductor 102A. Those particles 106 may provide a transverse conductive connection between the exterior conductor 102A and the crimp barrel 206 (shown in FIG. 2) of the terminal 202 (FIG. 2). The particles 106, prior to crimping, may be secured to the surfaces of the conductors 102 via intermolecular forces, such as covalent bonds for example. The particles 106 alternatively or additionally may be secured to the conductors 102 via an interference fit within the interstices 112 defined between the conductors 102. For example, during the application process, the particles 106 may be sprayed into the interstices 112 through the end 108 of the wire 100, and the particles 106 may travel axially along the wire 100 until the size of the corresponding interstice 112 decreases to an extent that the respective particle 106 engages the surrounding conductors 102 and is held in place by a friction or interference fit. Optionally, the particles 106 may extend into the wire 100 for a length that is beyond the end segment 110, meaning that some particles 106 extend into the portion of the wire 100 surrounded by the sheath 104 in FIG. 1.

Each electrical conductor 102 includes a metallic surface 162 that defines an exterior surface of the aluminum material of the electrical conductor 102. The electrical conductors 102 may also include oxide layers 164 that are formed on the metallic surfaces 162 of the electrical conductors 102, for example when the electrical conductors 102 are exposed to air. The oxide layers 164 have relatively poor electrical conductivity. Accordingly, to establish a reliable electrical connection between one electrical conductor 102 and another electrical conductor 102 and/or the crimp barrel 206 (shown in FIG. 2) of a terminal 202 (FIG. 2), the oxide layer 164 must be displaced and/or penetrated to expose the metallic surface 162 of the electrical conductor 102, for example as part of a crimping process. Thus, with the aluminum conductors 102, it may be advantageous to improve the electrical conductivity in the transverse direction between adjacent conductors 102. Although only the oxide layer 164 is only illustrated on one of the conductors 102 in FIG. 1, it is recognized that all or at least some of the conductors 102 may include oxide layers 164 that are detrimental to conductivity. The thickness of the oxide layer 164 may be exaggerated in FIG. 1 to better illustrate the oxide layer 164.

The conductive particles 106 may be formed of a metal material, such as copper or a copper alloy. For example, the conductive particles 106 in an embodiment are formed of brass (an alloy containing at least copper and zinc). Optionally, the conductive particles 106 may include at least one other metal in addition to copper and zinc, such as tin, aluminum, iron, nickel, gold, titanium, magnesium, or chromium.

The conductive particles 106 may be a finely divided metal powder. The particles 106 may be produced by mechanically crushing, grinding, or chipping a block or sheet of metal into a powder (such as a brass powder). The particles 106 alternatively may be produced chemically as a precipitant resulting from a chemical reaction. The particles 106 as a result may have sharp or jagged edges, which allow the particles 106 to embed into the surfaces of the conductors 102 and penetrate the oxide layers 164 to provide the transverse conductive connections. Once the transverse connection is established between two or more conductors 102, the conductive connection may not be interrupted or degraded by subsequent oxidation along the surfaces of the conductors 102. Depending on the size of the interstices 112 between the conductors 102, the conductive particles 106 may have a size in the range between 1 μm and 100 μm. For example, the particles 106 may have a size in the range between 10 μm and 60 μm. The particles 106 have a size that fits within the interstices 112 during application of the particles 106 to the end segment 110 of the wire 100, yet the particles 106 are large enough to penetrate and/or break apart the oxide layers 164 of the conductors 102.

Figure 3:
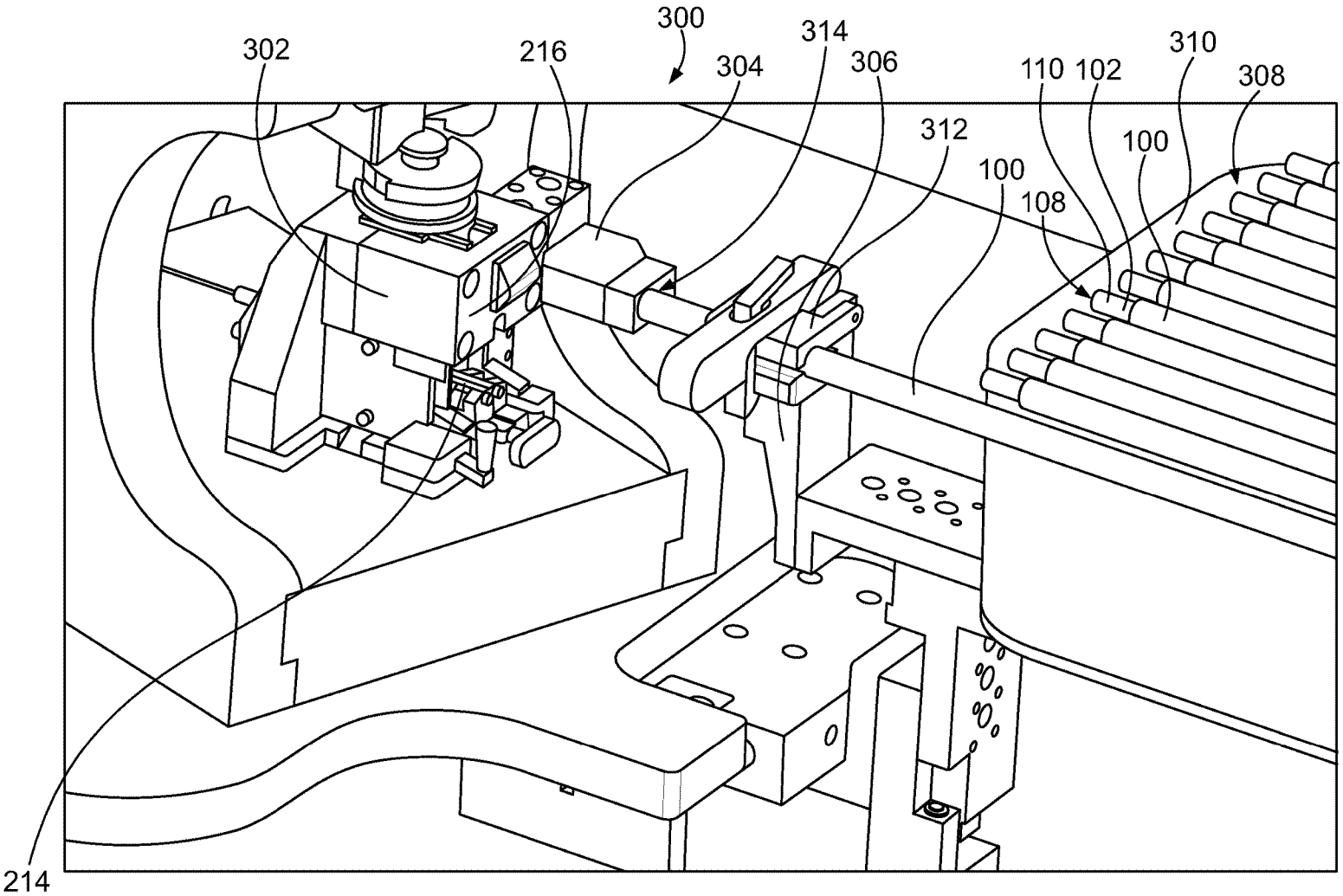
FIG. 3 is a perspective view of a wire processing system for forming a terminal assembly according to an embodiment.

FIG. 3 is a perspective view of a wire processing system 300 for forming a terminal assembly according to an embodiment. The wire processing system 300 includes a crimping device 302, a particle applicator device 304, and a transfer arm 306. The crimping device 302 may be the crimping device 200 that is illustrated in FIG. 2. The particle applicator device 304 (referred to herein as particle applicator 304) is configured to apply conductive particles (such as the particles 106 shown in FIG. 1) into ends 108 of wires 100, one wire 100 at a time. The particle applicator 304 is shown and described in more detail with reference to FIG. 4. In the wire processing system 300, the crimping device 302 is located proximate to the particle applicator 304. Thus, each wire 100 may be loaded into the application device 304 for receiving the conductive particles, and then each wire 100 may be immediately transferred to the crimping device 302 for termination to a terminal 202 (shown in FIG. 2) to form a terminal assembly 204 (FIG. 2). The proximity and quick transition between the particle applicator 304 and the crimping device 302 may reduce an amount of particles falling off of the conductors 102 of the wires 100 prior to the crimping operation.

In the illustrated embodiment, a group 308 of wires 100 is loaded on a tray 310. The transfer arm 306 is configured to grip one wire 100 at a time. The transfer arm 306 may be movable in multiple directions and along multiple different axes. The transfer arm 306 grips the wire 100 in a clamp 312. The transfer arm 306 presents the wire 100 first to the particle applicator 304. The end 108 of each wire 100 is loaded into a port 314 of the particle applicator 304. Within the particle applicator 304, conductive particles are applied to the conductors 102 along the end 108 of the wire 100, such as through spraying, dipping, brushing, or the like. The particles are applied between the conductors 102, and not only around a perimeter of the bundle of conductors 102. Once the particles are applied, the transfer arm 306 backs the wire 100 out of the port 314 and moves the wire 100 laterally to the crimping device 302. The transfer arm 306 loads the end segment 110 of the wire 100 into the crimp barrel 206 (shown in FIG. 2) of a terminal 202 (FIG. 2) located on an anvil 214 of the crimping device 302. The crimp tooling member 216 is subsequently propelled along the crimp stroke towards the anvil 214 to form the crimp barrel 206 over and into engagement with the conductors 102 of the wire 100, producing a terminal assembly 204 (shown in FIG. 2). After the terminal assembly 204 is formed, the transfer arm 306 may carry the terminal assembly 204 to a storage bin or to another processing device. After the transfer arm 204 releases the terminal assembly 204, the transfer arm 306 may be configured to return to the tray 310 to pick up another wire 100 to repeat the processing steps detailed above. In an alternative embodiment, an operator may assist the placing of wires 100 into the clamp 312 on the transfer arm 306.

Figure 4:
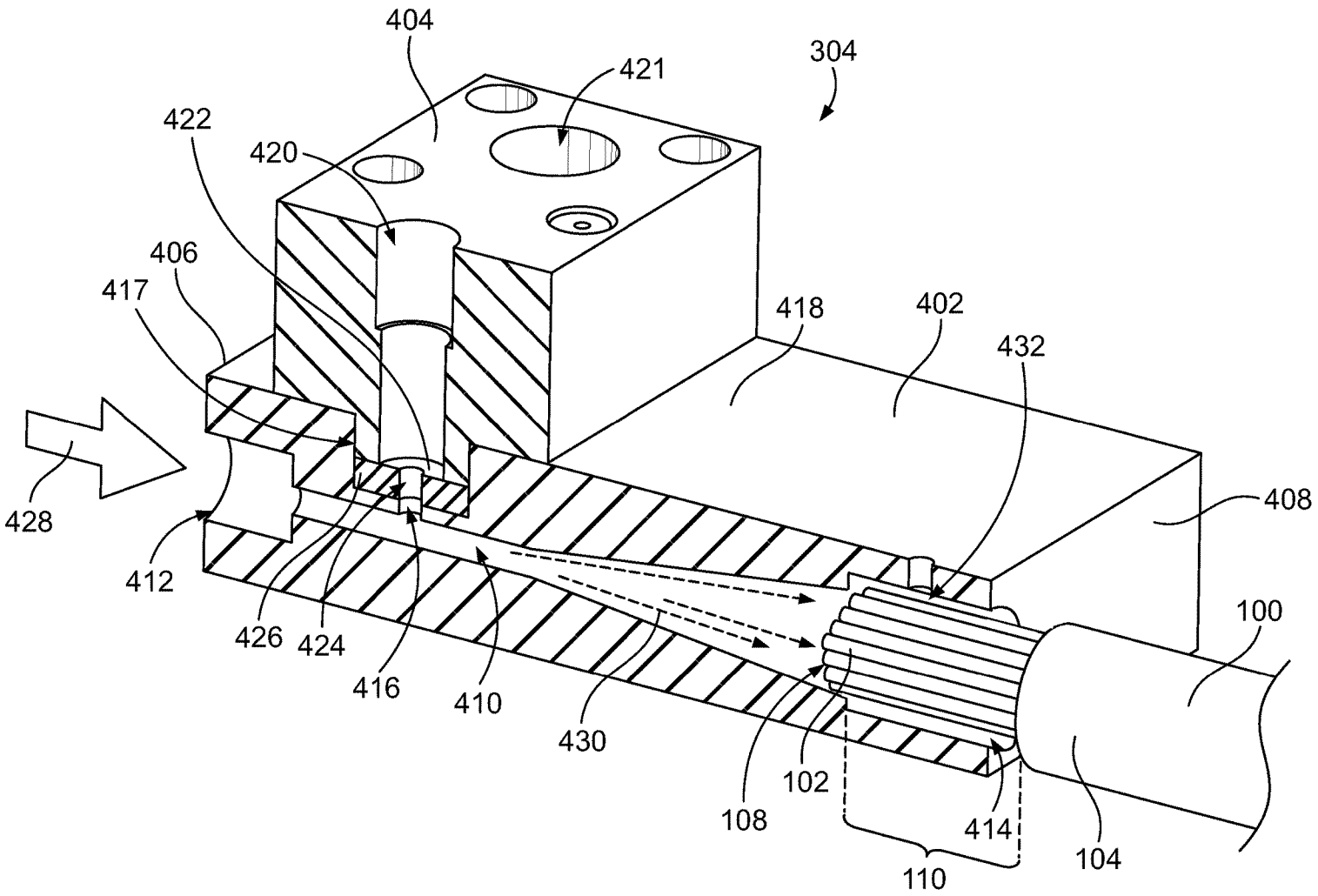
FIG. 4 is a cross-sectional view of a particle applicator device of the wire processing system according to an embodiment.

FIG. 4 is a cross-sectional view of the particle applicator device 304 shown in FIG. 3 according to an embodiment. The particle applicator 304 is configured to supply conductive particles (for example, the conductive particles 106 shown in FIG. 1) to an electrical wire 100. The particle applicator 304 includes a guide block 402, a particle storage device 404, and a pressurized air feeder (not shown). The guide block 402 extends laterally between a rear 406 and a front 408. As used herein, relative or spatial terms such as "top," "bottom," "front," "rear," "left," and "right" are only used to distinguish the referenced elements and do not necessarily require particular positions or orientations in the particle applicator 304, the wire processing system 300 (shown in FIG. 3), or in the surrounding environment. The guide block 402 defines a channel 410 that extends through the guide block 402 between a first opening 412 at the rear 406 and a second opening 414 at the front 408. The channel 410 provides a flow path for the conductive particles. The channel 410 is configured to receive the end segment 110 of the wire 100 through the second opening 414, such that the electrical wire 100 extends from the front 408 of the guide block 402. For example, the second opening 414 may be sized to accommodate the conductors 102 along the end segment 110, but not the sheath 104 surrounding the portions of the conductors 102 beyond the end segment 110. Alternatively, at least a portion of the sheath 104 may be received within the second opening 414. In an embodiment, the guide block 402 further defines an orifice 416 located axially between the front 408 and the rear 406 of the guide block 402 that provides an entrance path for conductive particles into the channel 410. In the illustrated embodiment, the orifice 416 is concentric with a recess 417 in the guide block 402. The recess 417 is defined in an outer wall 418 of the guide block 402. The orifice 416 is open to the recess 417, and the orifice 416 and the recess 417 together define a path between the outer wall 418 and the channel 410. In an alternative embodiment, the conductive particles may be loaded into the channel 410 through the first opening 412 or another opening.

The particle storage device 404 may be coupled to the guide block 402. The particle storage device 404 is configured to house a bulk supply of conductive particles and to provide a designated amount of the conductive particles to the channel 410 for each application of the particles into a corresponding wire 100. For example, the particle storage device 404 defines a reservoir 421 that may house the bulk supply of conductive particles therein. The reservoir 421 is spaced apart from a cavity 420 that is an auxiliary air inlet for the channel 410. For example, an air stream may enter the channel 410 through the opening 412 or the cavity 420. The cavity 420 is aligned with the orifice 416 of the guide block 402.

The particle storage device 404 selectively provides a designated amount or portion of the conductive particles from the reservoir 421 to the channel 410 of the guide block 402 through the orifice 416. For example, the particle storage device 404 includes a metering plate 426 that is moveable relative to the guide block 402. The metering plate 426 extends laterally between the reservoir 421 and the cavity 420. The metering plate 426 is slidable between a loading position and an unloading position. In the loading position, an aperture 424 in the metering plate 426 aligns with the reservoir 421 and at least partially fills with a supply of conductive particles. In the unloading position, the aperture 424 aligns with the orifice 416, and the conductive particles are unloaded (via gravity) into the channel 410 through the orifice 416. The metering plate 426 in the loading position may include a solid surface that seals the orifice 416, preventing the conductive particles in the channel 410 from being blown back into the cavity 420. The aperture 424 may be sized and/or shaped to provide a regulated or measured amount of conductive particles to the channel 410 for each application to control the amount of particles applied to each wire 100.

The pressurized air feeder 802 (shown in FIG. 8) is configured to supply an air stream 428 to the channel 410 through an air inlet, which may be the first opening 412 at the rear 406 of the guide block 402 or through the cavity 420. The air feeder 802 may be a nozzle that is coupled to a hose that directs pressurized or compressed air from a compressed air tank through the nozzle. The air stream 428 flows through the channel 410 towards the second opening 414 (and any wire 100 loaded into the second opening 414). For example, the air stream 428 flows axially into an end 108 of the wire 100 loaded in the channel 410. Any conductive particles disposed within the channel 410 may be forced and/or picked up by the air stream 428 as a spray 430 that is delivered axially to the end 108 of the wire 100. The particles in the spray 430 may be received in the interstices 112 (shown in FIG. 1) between adjacent conductors 102. At least some particles may also be secured to the exterior surfaces of exterior conductors 102A (shown in FIG. 1). The force of the air stream 428 may propel the particles to varying distances within the wire 100, such that some particles may be located up to or beyond the sheath 104. In an embodiment, the air stream 428 is vented from channel 410 through the second opening 414. For example, the air may flow around the wire 100 (after supplying the particles to the conductors 102) through a gap 432 between the conductors 102 and the walls of the channel 410 to reduce the pressure in the channel 410.

The particle applicator 304 shown in FIG. 4 illustrates a mechanism for applying conductive particles axially into an end of an electrical wire such that the particles are received between adjacent conductors within an interior of the bundle of conductors. In other embodiments, conductive particles may be applied between the conductors of an electrical wire by other processes, such as dipping, brushing, or the like, described further with reference to FIG. 5.

Figure 5:
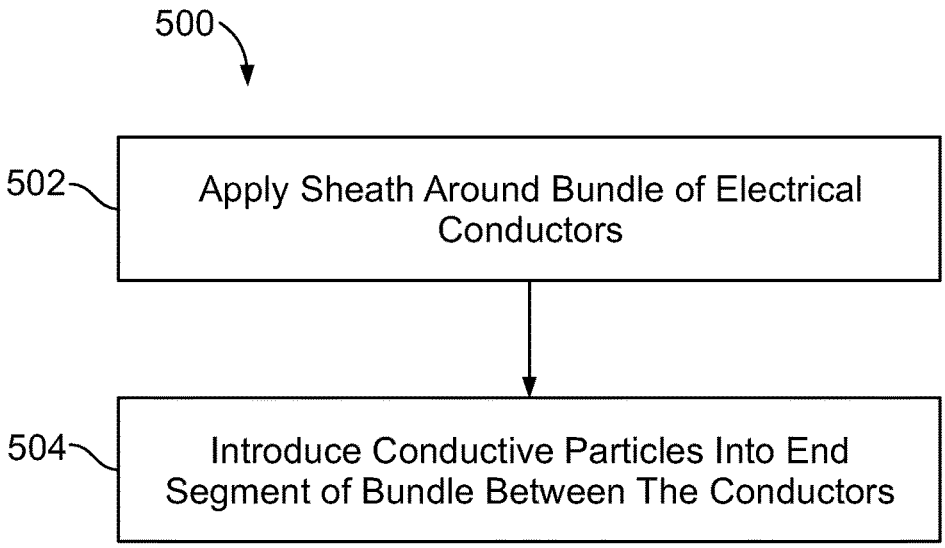
FIG. 5 is a flow chart of a method for producing an electrical wire according to an embodiment.

FIG. 5 is a flow chart of a method 500 for producing or forming an electrical wire according to an embodiment. The electrical wire may be the wire 100 shown in FIG. 1. The method 500 includes, at 502, applying an electrically insulating sheath around a bundle of plural electrical conductors. The bundle of electrical conductors may not be twisted or helically wound, or may have only limited twist. The sheath may be composed of a non-conductive or dielectric material, such as a plastic or rubber-like polymer. Optionally, the sheath is not applied around an end segment of the bundle of conductors that extends to the end of the wire. Alternatively, the sheath is applied along the entire length of the wire, including the end segment, but subsequently the sheath is at least partially removed from the end segment. In an another alternative embodiment, the sheath extends the full length of the wire and is not removed at least until after introducing conductive particles into the end of the wire, as described in step 504 below.

At 504, conductive particles are introduced into the end segment of the bundle of electrical conductors such that the conductive particles engage and are disposed between at least some of the electrical conductors in the bundle. The conductive particles are introduced into the end segment after the wire is constructed, meaning that the wire includes the bundle of conductors and the sheath applied around the bundle. The conductive particles may be introduced into the end segment through an end of the bundle of conductors. The particles may enter the end segment via interstices or gaps between adjacent electrical conductors. The conductive particles may be introduced into the end segment by spraying the conductive particles in an axial direction into the end of the bundle of conductors, as shown in FIG. 4. Some of the particles may enter the end segment in a radially inward direction from a peripheral side of the end segment instead of entering through the end of the bundle. In an alternative embodiment that is not shown, the particles are sprayed from a radial direction into the end segment of the bundle of electrical conductors, instead of or in addition to being sprayed axially into the end segment.

In an alternative embodiment, the conductive particles may be introduced into the end segment of the bundle by dipping the end segment into a composition or substance that includes the conductive particles and a carrier agent. For example, the conductive particles may be mixed with the carrier agent, which provides a vehicle for applying the particles to the conductors. For example, the carrier agent may be or include organic solvents (such as acetone and alcohols), oils, fats, and the like. The conductive particles may be mixed with the carrier agent to form a liquid solution or a paste. The end segment of the wire may be dipped into the liquid solution or paste. Alternatively, the liquid solution or paste may be brushed onto the end segment of the wire to allow the conductive particles to penetrate areas between interior conductors.

Figure 6:
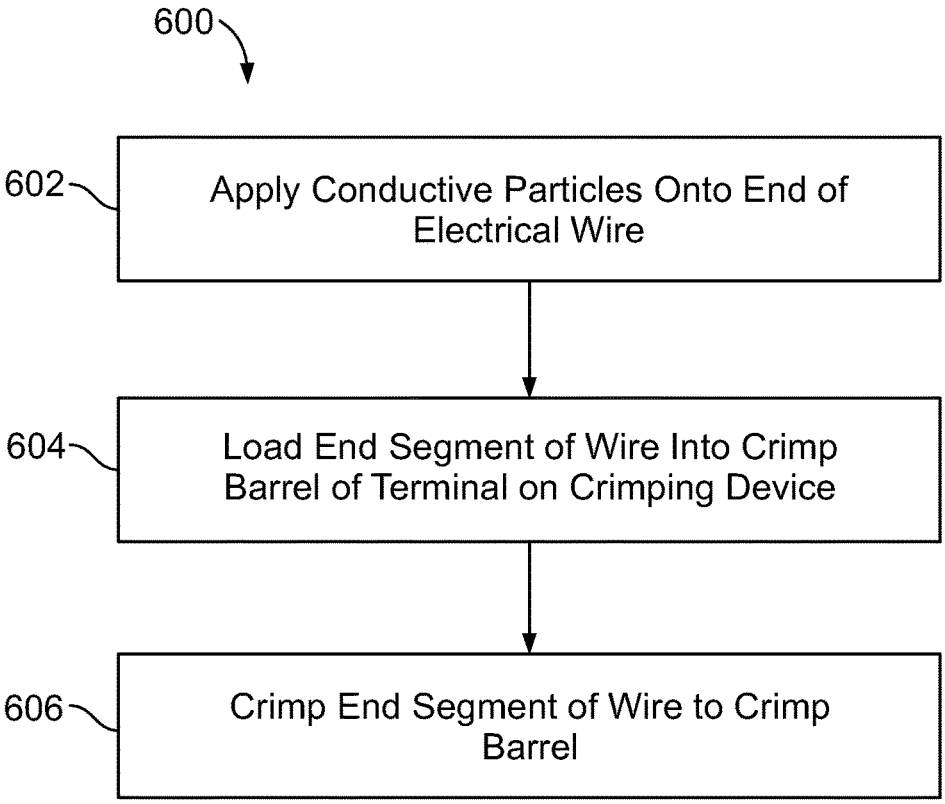
FIG. 6 is a flow chart of a method for producing a terminal assembly according to an embodiment.

FIG. 6 is a flow chart of a method 600 for producing a terminal assembly according to an embodiment. The terminal assembly may be the terminal assembly 204 shown in FIG. 2, which includes the electrical wire 100 shown in FIG. 1. The method 600 may be performed by the wire processing system 300 shown in FIG. 3. At 602, conductive particles are applied onto an end of an electrical wire (for example, the wire 100) such that at least some of the conductive particles are received between at least some electrical conductors within the wire. Application of the conductive particles onto the end of the wire may include loading the end of the wire into a channel of a particle applicator device and using a pressurized air stream to blow a designated amount of the conductive particles through the channel axially onto the end of the wire. Alternatively, the conductive particles may be sprayed radially onto the end segment of the bundle. In an alternative embodiment, the conductive particles may be applied onto the end segment by dipping the end segment into a composition or substance that includes the conductive particles and a carrier agent or by brushing such composition onto the end segment of the wire. Optionally, a mechanical transfer arm grips the wire to load the end of the wire into the channel of the particle applicator. The mechanical transfer arm may also be configured to subsequently remove the wire from the particle applicator after the conductive particles are applied onto the wire to move the wire to the crimping device.

At 604, an end segment of the wire is loaded into a crimp barrel of a terminal that is located on an anvil of a crimping device. The wire may be loaded into the crimp barrel of the terminal immediately upon receiving the spray of particles. For example, the wire may be moved directly from the particle applicator to the crimping device, without being moved to an intermediary location, such as a storage bin, before being loaded into the crimp barrel. The transfer arm may be used load the end segment of the wire into the crimp barrel of the terminal on the anvil. At 606, the crimp barrel of the terminal is crimped onto the end segment of the wire to mechanically and electrically connect the terminal to the electrical conductors of the wire. Crimping the crimp barrel to the wire may include driving a crimp tooling member downwards toward the anvil of the crimping device. The crimp tooling member may define a forming profile that engages the crimp barrel, such as tabs of the crimp barrel, and bends the tabs of the crimp barrel over a top of the electrical conductors into engagement with the conductors. The forces applied on the crimp barrel between the crimp tooling member and the anvil mechanically and electrically connect the terminal to the wire, forming the terminal assembly.

In an embodiment, the conductive particles are a brass powder, and the electrical conductors of the wire are composed of aluminum. The brass particles are harder than aluminum, and act as an abrasive on the surfaces of the aluminum conductors, much like grit. The brass particles may penetrate and/or break apart the oxide layers that surround the aluminum conductors, especially when the conductors are compressed by the crimp barrel of the terminal during the crimping operation. The brass particles may get embedded into the aluminum interior regions of the conductors. A particle embedded in two adjacent conductors may provide a transverse conductive connection or current path between the adjacent conductors (more specifically between the aluminum interior regions of the conductors which are more conductive than the oxide layers along the perimeter of the conductors). Thus, the brass particles improve conductivity between conductors within the bundle of conductors by breaking up oxide layers and providing transverse connections between the more conductive aluminum interior regions of the conductors. Furthermore, the brass particles in an embodiment are compatible with both aluminum of the conductors and copper of the terminal. The brass particles may form an intermetallic layer between adjacent conductors and/or between an exterior conductor and the terminal during the crimping operation. The intermetallic layer may provide a mechanically stronger and more electrically conductive bond between the conductors and/or between the conductor and the terminal than if the brass particles are not present along and within the end segment of the wire. It is recognized that other embodiments of the inventive subject matter described herein are not limited to the conductive particles being brass powder and the electrical conductors of the wire including aluminum.

Figure 7:
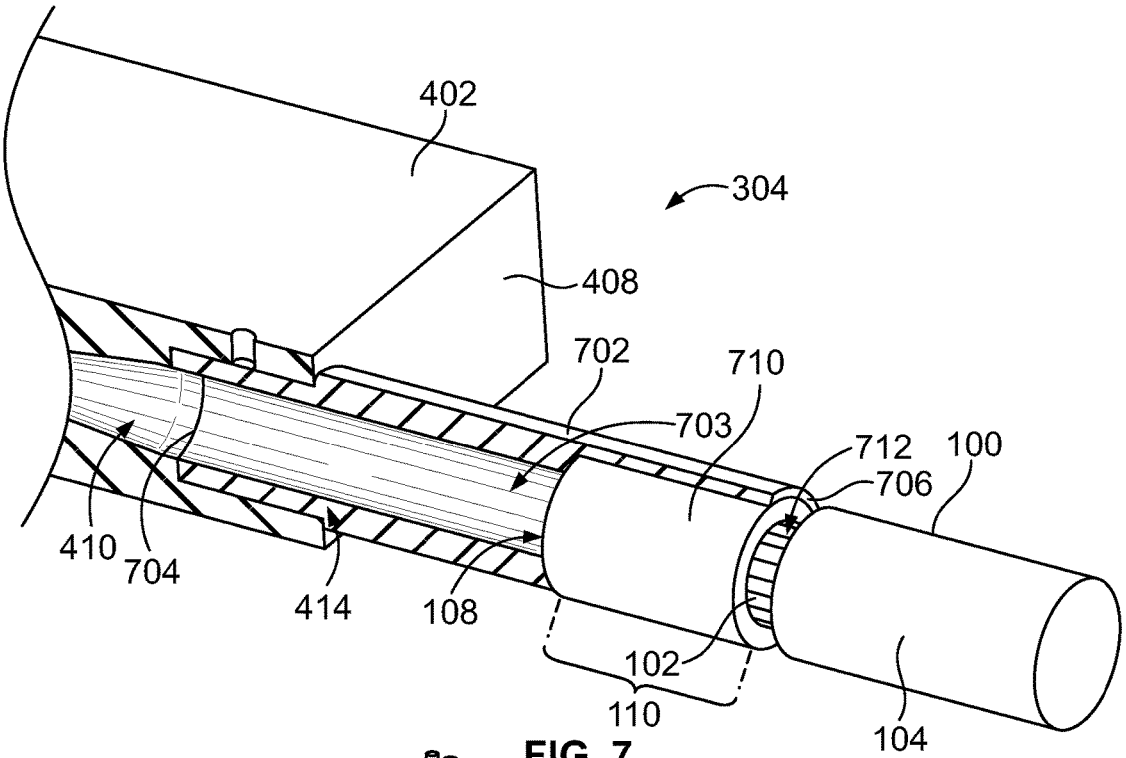
FIG. 7 is a cross-sectional view of a portion of the particle applicator device shown in FIG. 4 according to another embodiment.

FIG. 7 is a cross-sectional view of a portion of the particle applicator device 304 shown in FIG. 4 according to another embodiment. The illustrated portion of the particle applicator device 304 shows the front 408 of the guide block 402. The channel 410 of the guide block 402 is fluidly connected to the electrical wire 100 via an extender tube 702. The extender tube 702 has a hollow core 703 that is configured to increase the length of the channel 410. The extender tube 702 extends between a first end 704 and a second end 706. The first end 704 is received in the second (or front) opening 414 of the guide block 402 and the remainder of the extender tube 702 extends remote from the front 408 of the guide block 402. The first end 704 may form an air-tight seal with the opening 414. The end segment 110 of the wire 100 is received in the hollow core 703 through the second end 706 of the tube 702. Optionally, the end segment 110 may form an air-tight seal with the second end 706. During operation of the particle application device 304, conductive particles 106 (shown in FIG. 1) are configured to be sprayed through the channel 410 of the guide block 402 and then through the hollow core 703 of the extender tube 702 to the electrical wire 100. In an alternative embodiment, the extender tube 702 may be formed as an integral component with the guide block 402 instead of a discrete component coupled to the guide block 402.

In an embodiment, the electrical wire 100 may include an insulating cuff segment 710 of the insulating layer or sheath 104 that surrounds at least a portion of the end segment 110 of the wire 100 during the application or introduction of conductive particles into the electrical conductors 102. The cuff segment 710 is spaced apart from the remainder of the sheath 104 by an exposed region 712. The electrical conductors 102 are not surrounded by an insulating layer along the exposed region 712. The cuff segment 710 may be formed by cutting (e.g., slicing, stripping, etc.) the sheath 104 around a perimeter of the sheath 104 to isolate the cuff segment 710 without cutting or otherwise damaging the electrical conductors 102 along the exposed region 712 that is formed. The cuff segment 710 may extend to the end 108 of the wire 100. The cuff segment 710 is configured to be loaded into the hollow core 703 of the extender tube 702 (as shown) and/or directly into the opening 414 of the guide block 402. The cuff segment 710 may seal against interior surfaces or walls of the tube 702 and/or guide block 402, forming an air-tight seal. During operation of the particle application device 304, the conductive particles may be introduced into the electrical conductors 102 radially interior of the cuff segment 710. At least some of the air may be vented and exhausted from the channel 410 through the exposed region 712. Therefore, the air may flow through the cuff segment 710 and out of the wire 100 in the region 712 between the cuff segment 710 and the sheath 104. Optionally, one or more venting slots (not shown) may be provided in the guide block 402 and/or the tube 702. In an embodiment, after application of the conductive particles to the conductors 102, the cuff segment 710 may be removed from the end segment 110 of the wire 100 prior to a crimping operation or another termination operation.

Figure 8:
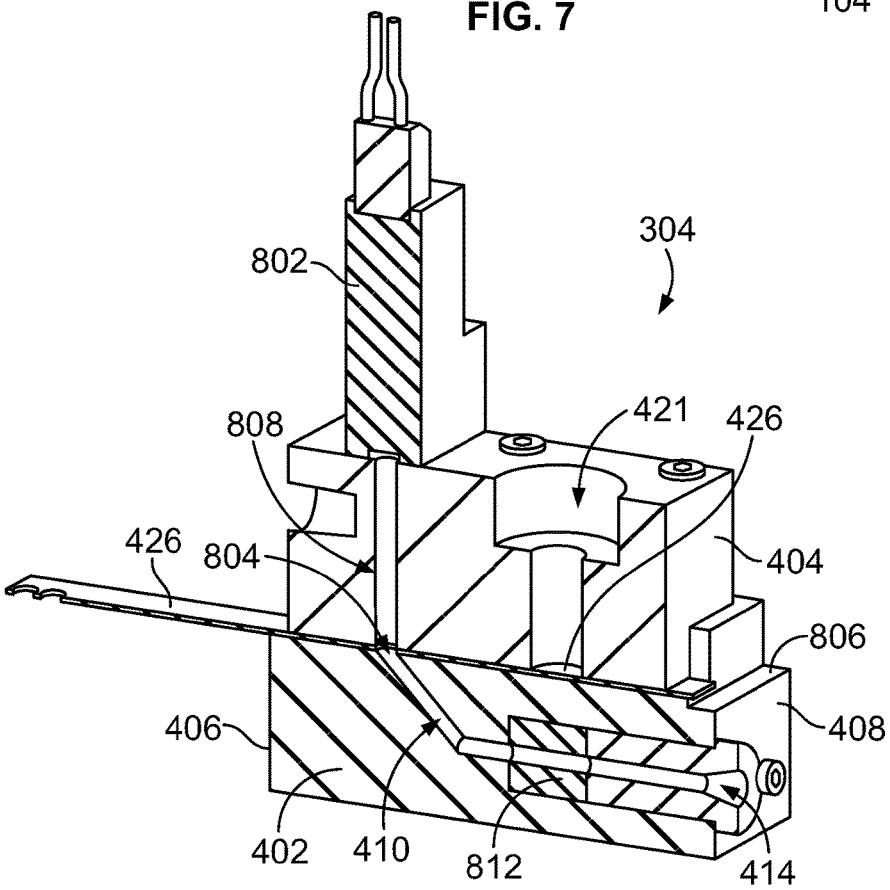
FIG. 8 is a cross-sectional view of the particle applicator device shown in FIG. 4 according to another embodiment.

FIG. 8 is a cross-sectional view of the particle applicator device 304 shown in FIG. 4 according to another embodiment. In the illustrated embodiment, the channel 410 does not extend linearly between the front 408 and rear 406 of the guide block 402. Rather, the channel 410 extends from the second (or front) opening 414 to an air inlet 804 along a top 806 of the guide block 402. The channel 410 is not linear in the illustrated embodiment. The air inlet 804 is fluidly connected to a cavity 808 of the particle storage device 404. The particle storage device 404 is coupled to the pressurized air feeder 802, which supplies an air stream through the cavity 808, which continues through the channel 410 towards the opening 414. The cavity 808 extends along an axis that is transverse (e.g., perpendicular) to an axis of the channel 410 leading up to the opening 414.

In the illustrated embodiment, the metering plate 426 is shown to extend along a length that is parallel to the length of the guide block 402 between the front 408 and the rear 406. The metering plate 426 is configured to slide relative to the guide block 402 along the top 806 of the guide block 402 along a sliding axis that is parallel to the length of the metering plate 426. For example, the metering plate 426 is configured to transport a designated supply of particles from the reservoir 421 to the channel 410 at the air inlet 804 of the channel 410.

Optionally, the guide block 402 may be configured to receive an optical sensor (not shown). The optical sensor monitors the channel 410 to provide diagnostic information such as a flow rate of the air stream through the channel 410, an amount of particles being picked up by the air stream, or the like. The diagnostic information could provide feedback regarding an application of particles to a wire, including "shot ok," "no powder (or particles)," "no wire," and/or "bad shear." The guide block 402 may include a transparent body 812 between the optical sensor and the channel 410 in order to provide an optical path for the sensor. The transparent body 812 may define a portion of the channel 410. The transparent body 812 may be formed of a transparent or at least translucent material, such as glass, quartz, or sapphire.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical wire comprising:

a bundle of electrical conductors having an end segment that extends to an end of the bundle, each electrical conductor in the bundle engaging at least one other electrical conductor, the electrical conductors including exterior conductors along a perimeter of the bundle and interior conductors radially interior of the exterior conductors; and conductive particles disposed between and engaging at least some of the electrical conductors in the bundle along the end segment, the conductive particles engaging both the interior conductors and the exterior conductors and configured to provide an electrical connection between the corresponding electrical conductors engaged by the conductive particles.

2. The electrical wire of claim 1, wherein at least some of the electrical conductors are composed of aluminum.

3. The electrical wire of claim 2, wherein the conductive particles penetrate an oxide layer that surrounds metallic surfaces of the corresponding electrical conductors engaged by the conductive particles, the conductive particles electrically connecting the metallic surfaces of adjacent electrical conductors that engage one or more of the same conductive particles.

4. The electrical wire of claim 1, wherein the conductive particles are a metal powder.

5. The electrical wire of claim 1, wherein the conductive particles are a brass powder.

6. The electrical wire of claim 1, wherein at least some of the conductive particles are disposed in interstices defined between adjacent electrical conductors.

7. The electrical wire of claim 1, further comprising an electrically insulating sheath surrounding the bundle of electrical conductors along at least a portion of the end segment, one or more of the conductive particles being disposed within the sheath.

8. The electrical wire of claim 1, wherein the conductive particles are secured to the electrical conductors via at least one of intermolecular forces or interference fits.

9. The electrical wire of claim 1, wherein the electrical conductors are not helically wound around one another.

10. The electrical wire of claim 1, wherein at least some of the conductive particles are disposed within the bundle of electrical conductors and engage the interior conductors at locations that are spaced apart from the end of the bundle.

11. The electrical wire of claim 1, wherein the bundle of electrical conductors defines interstices between adjacent electrical conductors that are open at the end of the bundle, at least some of the interstices having a larger size than at least some of the conductive particles and receiving one or more of the conductive particles therein through the end of the bundle.

12. The electrical wire of claim 1, wherein the conductive particles have respective sizes between about 10 μm and about 60 μm.

13. The electrical wire of claim 1, wherein the conductive particles are a brass powder and the electrical conductors are composed of aluminum.

14. The electrical wire of claim 1, wherein some of the conductive particles are located on the exterior conductors along the perimeter of the bundle and other of the conductive particles are located inside of the bundle radially interior of the exterior conductors.

* * * * *